US009424976B2

(12) United States Patent
Suzuki

(10) Patent No.: US 9,424,976 B2
(45) Date of Patent: Aug. 23, 2016

(54) REACTOR

(71) Applicant: Tamura Corporation, Nerima-ku (JP)

(72) Inventor: Kotaro Suzuki, Sakado (JP)

(73) Assignee: TAMURA CORPORATION, Nerima-ku (JP)

( * ) Notice: Subject to any disclaimer, the term of this patent is extended or adjusted under 35 U.S.C. 154(b) by 226 days.

(21) Appl. No.: 14/103,004

(22) Filed: Dec. 11, 2013

(65) Prior Publication Data

US 2014/0159844 A1 Jun. 12, 2014

(30) Foreign Application Priority Data

Dec. 11, 2012 (JP) ..... 2012-270157
Dec. 12, 2012 (JP) ..... 2012-271762

(51) Int. Cl.

| | |
|---|---|
| ***H01F 27/26*** | (2006.01) |
| ***H01F 27/06*** | (2006.01) |
| ***H01F 27/24*** | (2006.01) |
| ***H01F 17/04*** | (2006.01) |
| ***H01F 37/00*** | (2006.01) |
| *H01F 27/02* | (2006.01) |

(52) U.S. Cl.

CPC ..... *H01F 27/06* (2013.01); *H01F 37/00* (2013.01); *H01F 27/022* (2013.01)

(58) Field of Classification Search

USPC ..... 336/210

See application file for complete search history.

(56) References Cited

U.S. PATENT DOCUMENTS

| | | | | |
|---|---|---|---|---|
| 2012/0126928 | A1* | 5/2012 | Yoshikawa | H01F 27/306 336/221 |
| 2012/0194311 | A1* | 8/2012 | Suzuki | H01F 27/266 336/92 |
| 2012/0223794 | A1* | 9/2012 | Asakura | H01F 37/00 336/65 |
| 2013/0106556 | A1* | 5/2013 | Suzuki | B29C 70/68 336/212 |

FOREIGN PATENT DOCUMENTS

| | | |
|---|---|---|
| JP | 2004-241475 | 8/2004 |
| JP | 2008-147566 | 6/2008 |
| JP | 2009-026952 | 2/2009 |
| JP | 2009-272508 | 11/2009 |
| JP | 2012-114190 | 6/2012 |

* cited by examiner

*Primary Examiner* — Mangtin Lian
*Assistant Examiner* — Ronald Hinson
(74) *Attorney, Agent, or Firm* — Oblon, McClelland, Maier & Neustadt, L.L.P.

(57) ABSTRACT

A reactor includes a core made of a magnetic material; a resin mold that encloses the core; a coil that is wound around the core through the resin mold; a plurality of fasteners located on the resin mold; and a supporting member that is secured to the resin mold through the fasteners. At least one of the plurality of fasteners is a flexible fastener.

16 Claims, 9 Drawing Sheets

(a)

(b)

| | | NOT COATED | COATED | DECREASE RATIO |
|---|---|---|---|---|
| UP AND DOWN DIRECTION | FASTENER | 337.3MPa | 330.1MPa | 2.1% |
| | RESIN | 110.9MPa | 78.9MPa | 28.9% |
| LONGITUDINAL DIRECTION | FASTENER | 739.3MPa | 193.9MPa | 73.8% |
| | RESIN | 310.7MPa | 108.5MPa | 65.1% |
| WIDTH DIRECTION | FASTENER | 469.7MPa | 132.3MPa | 71.8% |
| | RESIN | 180.2MPa | 81.8MPa | 54.6% |

REACTOR

BACKGROUND OF THE INVENTION

1. Field of the Invention

The present invention relates to reactors that can be used for vehicles such as electric vehicles and hybrid vehicles and in environments subject to temperature changes.

2. Description of the Related Art

Reactors are passive elements that use a winding that introduces inductive reactance into an alternative component. A reactor includes a main body and a supporting member that secures the main body.

The main body of the reactor has a core, a resin mold, and a coil. The core is mainly made of a magnetic material. The core is enclosed in the resin mold and then the coil is wound on the outer surface of the resin mold. The support member is for example a bathtub shaped metal case that encloses the main body and also functions as a heat sink base.

Since such a reactor is composed of a main body enclosed in a resin enclosure and a case mainly made of a metal, it is necessary to consider the different linear expansion coefficients of resin and metal. In the past, a retainer was located on the upper surface of a resin mold and the resin mold was held by both the case and the retainer such that the main body was secured to the case (refer to for example JP2004-241475A and JP2008-147566A). A cushion rubber was located between the retainer and the upper surface of the resin mold so as to prevent the retainer from breaking the resin mold.

Since the cushion rubber absorbed a gap change that occurred between the main body and the case due to a heat change, the resin mold and the cushion rubber slid over the cushion rubber and thereby no stresses were imposed on each constituent member.

Although the structure in which the main body of the reactor is held by the retainer and the case is effective if the reactor is directly secured to the case. However, some reactors may have a structure in which the main body is not directly secured to the case, but through a plurality of fasteners. In this case, the main body is not held by the retainer and the case.

Thus, in such reactors, a gap change that occurs between the main body and the case due to different linear expansion coefficients causes a tensile stress and a compression stress to be imposed on the fasteners. The reactions against these stresses may break the main body and the case.

Next, another related art reference will be described. A resin mold of a reactor according to another related art reference has a plurality of metal fasteners that protrude from its periphery. The main body of the reactor is secured to the supporting member through the metal fasteners using bolts.

Generally, the metal fasteners are set as inserts in a die of the resin mold. The die is filled with a resin. As a result, the metal fasteners are formed integrally with the resin mold. In other words, one end of each of the metal fasteners is buried in the resin of the resin mold and the other end thereof is exposed therefrom (refer to for example JP2012-114190A, JP2009-272508A, and JP2009-026952A).

In recent years, vehicles such as electric vehicles and hybrid vehicles that use motors as drive sources have been rapidly developed. Thus, it has been concerned about whether or not reactors can withstand in environments where they are subject to large vibrations has been concerned as one of interests. Thus, the reactors need to have an improved robustness against vibrations propagated from the external environments.

A measurement result of the distribution of stresses imposed on ordinary reactors reveals that large stress concentrations occur at the bases of metal fasteners and at the boundaries of the bases of the fasteners and the resin mold. If a large external impact load is imposed at an ordinary reactor, it is likely that cracks occur at the boundaries of the bases of the fasteners and the resin mold and result in breaking the reactor.

SUMMARY OF THE INVENTION

The present invention is proposed to solve the foregoing problem. An object of the present invention is to provide a reactor that has a structure in which a main body and a case are secured through fasteners and that a gap change that occurs between the main body and the case as a supporting member due to different linear expansion coefficients does not cause them from being broken.

In addition, the present invention is to provide reactors that alleviate stress concentrations that occur at the resin mold due to large external impact loads and thereby prevent the resin mold from being broken.

To solve the foregoing problem, a reactor according to a first aspect of the present invention includes a core made of a magnetic material; a resin mold that encloses the core; a coil that is wound around the core through the resin mold; a plurality of fasteners located on the resin mold; and a supporting member that is secured to the resin mold through the fasteners. At least one of the plurality of fasteners is a flexible fastener.

The flexible fastener may have a fold portion that becomes a start point of deformation.

The flexible fastener may have a fold portion having two folds, the fold portion becoming a start point of deformation and horizontally protruding from the resin mold to the outside, folding two times, and then horizontally extending to the outside.

The flexible fastener may be coated with the resin formed integrally with the resin mold.

The flexible fastener may have a hole. A recessed region may be formed such that the flexible fastener except for the hole and a periphery thereof is coated with a resin. The recessed region may be formed by a resin edge that surrounds all the periphery of the hole.

The recessed region may be formed by a resin edge and be a region that extends from the edge to the fastener and that is not be coated with resin.

The plurality of fasteners may include an inflexible fastener besides the flexible fastener.

The inflexible fastener may be coated with the resin formed integrally with the resin mold.

The inflexible faster may be made of the resin integrated with the resin mold.

The core may be composed of magnetic blocks and spacers that are alternately stacked. The flexible fastener may be located in the stacked direction of the magnetic blocks and the spacers such that the flexible fastener easily deforms and on only one end of the resin mold. The inflexible fastener may be located on only the other end of the resin mold.

A part of the flexible fastener may be a fixed portion that does not freely deform.

The fixed portion may be coated with the resin formed integrally with the resin mold.

The fixed portion may be a base that becomes a protrusion base of the flexible fastener that protrudes from the resin mold.

The inflexible fastener may have a bolt hole at the tip and a recessed region connected to the bolt hole, the bolt hole being partitioned by an edge of the resin that surrounds at least a part of the periphery of the bolt hole, the recessed region being connected to the bolt hole. The support member may have a bolt hole and a ridge portion having the same size as the recessed region such that when the ridge portion is fit into the recessed region, the bolt hole of the inflexible fastener and the bolt hole of the supporting member are aligned.

A reactor according to another aspect of the present invention includes a core made of a magnetic material; a resin mold that encloses the core; a coil that is wound around the core through the resin mold; a plurality of fasteners located on the resin mold; a supporting member that is connected to the resin mold through the fasteners; and a retainer member that presses the fasteners to the supporting member. The fasteners are held by the supporting member and the retainer member so as to connect the resin mold and the supporting member through the fasteners and relatively slide the fasteners against the supporting member.

The fasteners may be coated with the resin formed integrally with the resin mold.

Each of the fasteners may have a hole formed at the tip. The supporting member may have an insertion portion connected to the hole, the diameter of the insertion portion being smaller than that of the hole. The supporting member and the resin mold may be connected through a free space formed between the hole of each of the fasteners and the insertion portion of the supporting member.

The insertion portion may be formed in the supporting member and have a ridge portion that is smaller than the hole of each of the fasteners and a bolt that is screwed into the ridge portion.

The bolt may have as the retainer member a flange having a protrusion length that is greater than the diameter of the hole of each of the fasteners. When the bolt is inserted into the ridge portion, the flange presses the edge of the hole.

The insertion portion may be a bolt that is screwed into the supporting member. The retainer member may be a cup-shaped disc spring. The disc spring may be located between a head portion of the bolt and the edge of the hole such that the head portion of the bolt presses the edge of the hole through the disc spring.

The supporting member may be made of a metal.

According to the present invention, even if a gap change occurs between the resin mold and the supporting member due to different linear expansion coefficients thereof, since the flexible fasteners deform such that they absorb the gap change that occurs, tensile stress and compression stress imposed at the fasteners can be prevented from propagating to the resin mold and the supporting member and from breaking them.

According to the present invention, stress concentrations that occur at the boundaries between the bases of the fasteners and the resin mold can be alleviated and thereby cracks that tend to occur at connected portions of the resin mold and the fasteners can be prevented. As a result, the reactors can be prevented from being broken in an early stage.

These and other objects, features and advantages of the present invention will become more apparent in light of the following detailed description of a best mode embodiment thereof, as illustrated in the accompanying drawings.

BRIEF DESCRIPTION OF THE DRAWINGS

The invention will become more fully understood from the following detailed description, taken in conjunction with the accompanying drawings, wherein similar reference numerals denote similar elements, in which:

FIG. 1(*b*) is a schematic diagram showing a final product of the main body of the reactor;

FIG. 1(*c*) is a schematic diagram showing a supporting member that encloses the main body of the reactor;

FIG. 13(*b*) is a sectional view showing a base coat portion of a fastener of the reactor according to another embodiment;

FIG. 13(*c*) is a sectional view showing a fold region coat portion of a fastener of the reactor according to another embodiment; and FIG. 13(*d*) and FIG. 13(*e*) are sectional views showing positions of resins coated on fasteners.

DETAILED DESCRIPTION OF THE PREFERRED EMBODIMENTS

First Embodiment

Overall Structure

Figure 1:
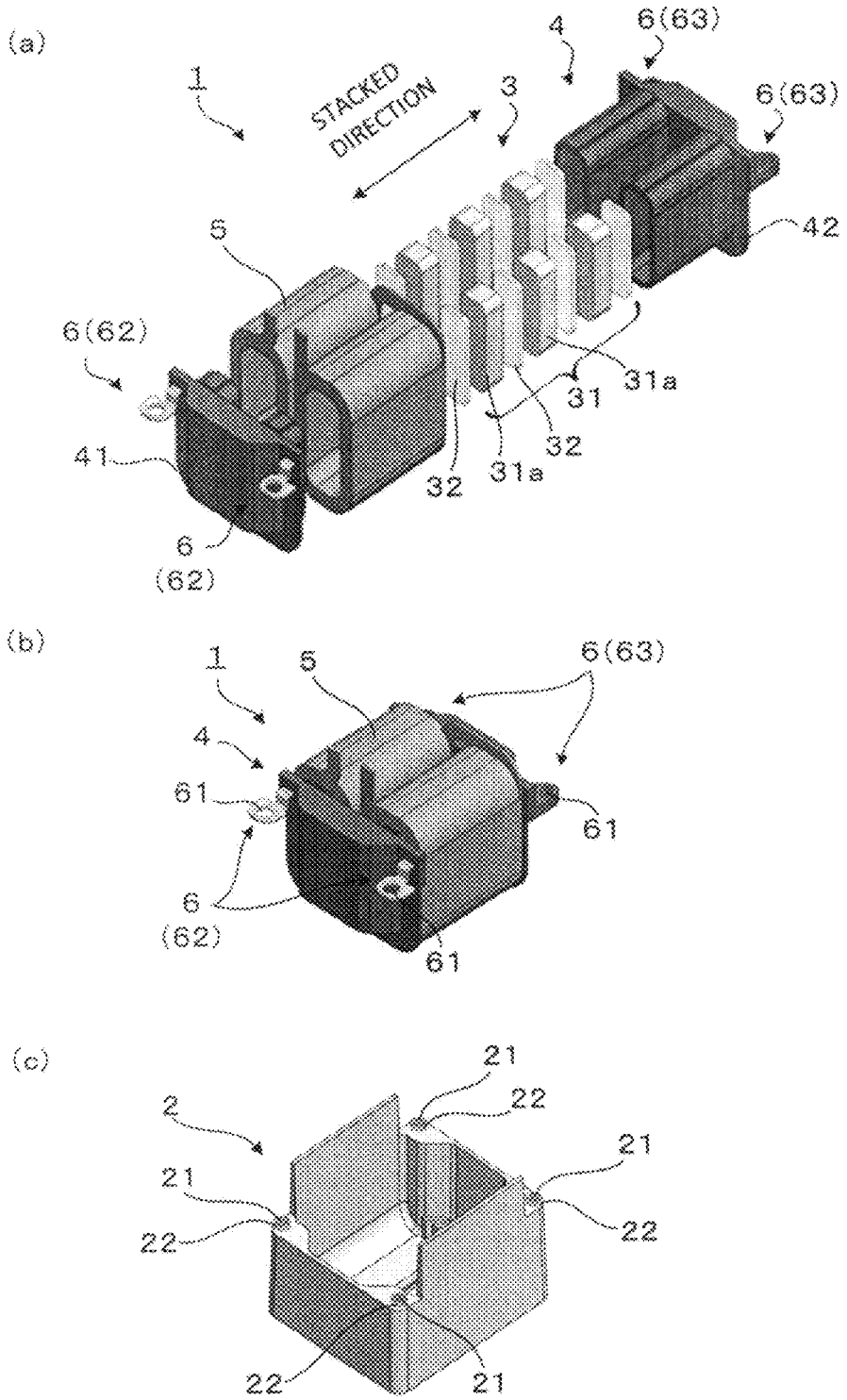
FIG. 1(*a*) is an exploded view showing a main body of a reactor according to a first embodiment of the present invention.

FIG. 1 shows a reactor according to a first embodiment of the present invention. The reactor shown in FIG. 1 is a passive element that uses a winding that introduces an inductive reactance to an alternating component. The reactor is used for inverter circuits, active filter circuits, DC booster circuits, and so forth. This reactor has a main body 1 and a supporting member 2 that secures the main body 1.

The main body 1 has a core 3, a resin mold 4, and a coil 5. The core 3 is mainly made of a magnetic material. The core 3 is enclosed in the resin mold 4. The coil 5 is wound on the outer surface of resin mold 4. The supporting member 2 is formed in a bathtub shape having a space corresponding to the size of the main body 1. The supporting member 2 and the resin mold 4 are made of different materials that have different linear expansion coefficients. Since supporting member 2 is made of a metal having a high thermal conductivity such as aluminum or magnesium, it also functions as a heat sink base for the main body 1.

The main body 1 and the supporting member 2 are connected with a plurality of fasteners 6 that protrude from the main body 1. If the fasteners 6 are made of a metal, they may be referred to as stays. In contrast, if the fasteners 6 are made of a resin, they may be referred to as ridges. The fasteners 6 have a wide tip in which a bolt hole 61 is formed. The bolt hole 61 of the fastener 6 and a bolt hole 21 formed in the supporting member 2 are aligned. When a bolt is inserted into these holes, the main body 1 and the supporting member 2 are connected.

At least one of the fasteners 6 is a flexible fastener 62. The flexible fastener 62 expands or shrinks so as to absorb the difference of the linear expansion coefficients of the main body 1 enclosed in a resin enclosure and the supporting member 2 mainly made of a metal. However, it is preferred that at least one of the other fasteners 6 is an inflexible fastener 63. The inflexible fastener 63 protects the reactor from an external impact load.

(Structure of Each Member)

The core 3 is mainly made of for example ferrite. The core 3 has a ring shape. The core 3 has a nearly square section. If the core 3 is viewed from a cavity portion at the center of the ring, the core 3 has an ellipse shape composed of two straight portions 31 having the same length and two semi circle portions (not shown) that connect the ends of the two straight portions 31.

Each of the straight portions 31 of the core 3 is separated into a plurality of magnetic blocks 31*a*. Spacers 32 made of ceramics or the like are interposed every between two magnetic blocks 31*a*. The magnetic blocks 31*a* and the spacers 32 are secured by an adhesive agent. The spacers 32 create a magnetic gap having a predetermined width for the magnetic blocks 31*a* so as to prevent the inductance of the reactor from lowering.

The resin mold 4 has a hollow ring shape corresponding to the core 3 such that the resin mold 4 encloses the core 3. The resin mold 4 has a nearly square shape. The resin mold 4 is a bobbin for the coil 5 and is an insulator that insulates the core 3 and the coil 5. The resin mold 4 is mainly made of for example unsaturated polyester resin, urethane resin, epoxy resin, BMC (Bulk Molding Compound), PPS (Polyphenylene Sulfide), or PBT (Polybutylene Terephthalate).

The resin mold 4 is composed of a first separate member 41 having a nearly C-letter shape and a second separate member 42 having a nearly U-letter shape. The first separate member 41 and the second separate member 42 are separately molded. When the first member 41 and the second member 42 are connected, the resin mold 4 is formed. The first separate member 41 encloses coil 5, whereas the second separate member 42 encloses straight portions 31 composed of the magnetic blocks 31*a* and the spacers 32. The semi circle portions (not shown) of the core 3 are set as inserts in a die of the first separate member 41 and the second separate member 42 so that the semi circle portions are formed integrally with the resin mold 4.

The coil 5 is an enamel-clad copper wire. The coil 5 is wound on the straight portions 31 of the core 3 through the resin mold 4. More specifically, the coil 5 is pre-would in a square pillar shape. The coil 5 is fit into the straight portion of nearly U-letter shape second separate member 42 that encloses the core 3. The inner ends of the pair of windings of the coil 5 are welded and electrically connected or successively connected. The outer ends of the pair of windings of the coils 5 are led out as lead wires.

The fasteners 6 protrude from the four corners of the resin mold 4 to the outside. For example, the fasteners 6 protrude from end surfaces of the resin mold 4 perpendicular to the direction in which the straight portions 31 of the core 3 extend, namely the stacked direction of the magnetic blocks 31*a* and the spacers 32. The flexible fasteners 62 are located at both the corners of one end of the resin mold 4. On the other hand, the inflexible fasteners 63 are located at both the corners of the other end of the resin mold 4.

Figure 2:
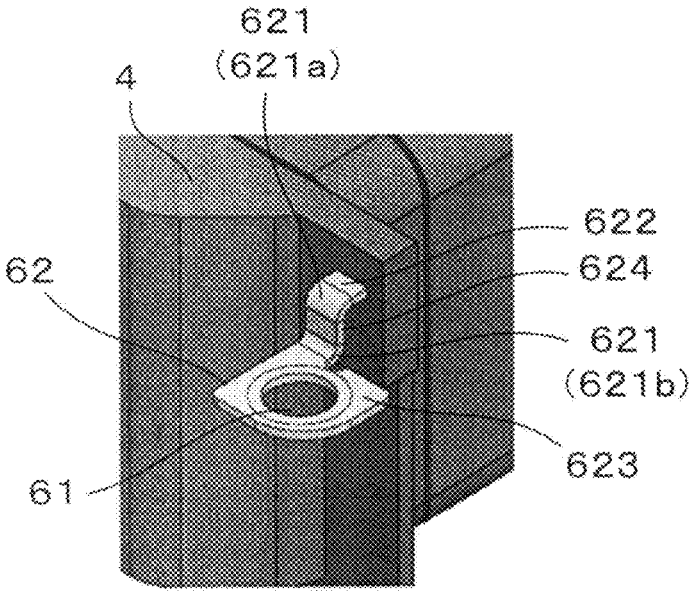
FIG. 2 is a perspective view showing a flexible fastener of fasteners with which the reactor according to the first embodiment is provided.

Since flexible fasteners 62 are set as inserts in the die of the resin mold 4, the flexible fasteners 62 are formed integrally with the resin mold 4. As shown in FIG. 2, the flexible fasteners 62 are flexible metal plates. The flexible fasteners 62 protrude from resin mold 4 in a tongue shape. The flexible fasteners 62 have a fold portion 621. The fold portion 621 is the start point of deformation at which flexible fastener 62 deforms. The fold portion 621 creates an expansion allowance in the stacked direction of the magnetic blocks 31*a* and the spacers 32.

The flexible fasteners 62 may elastically deform as a gap change between the resin mold 4 and the supporting member 2 occurs due to different linear expansion coefficients. However, it is preferred that the flexible fasteners 62 plastically deform such that the deformed flexible fasteners 62 do not impose tensile stresses or compression stresses at the resin mold 4 and the supporting member 2.

Although the number of folds of the fold portion 621 is not limited, it is preferred that the fold portion 621 have two folds. The fold portion 621 may be pleated such that it has at least one fold. As shown in FIG. 2, the flexible fastener 62 horizontally protrudes from a side surface of the resin mold 4 to the outside, folds two times, and then horizontally extends toward the outside so as to form a stage portion. In other words, the flexible fastener 62 has a base side horizontal portion 622 that protrudes from the resin mold 4; a fastening side horizontal portion 623 secured to the supporting member 2; a base side fold portion 621*a* and a fastening side fold portion 621*b* located between both the base side horizontal portion 622 and the fastening side horizontal portion 623; and a vertical portion 624 located between base side fold portion 621*a* and the fastening side fold portion 621*b*.

Figure 3:
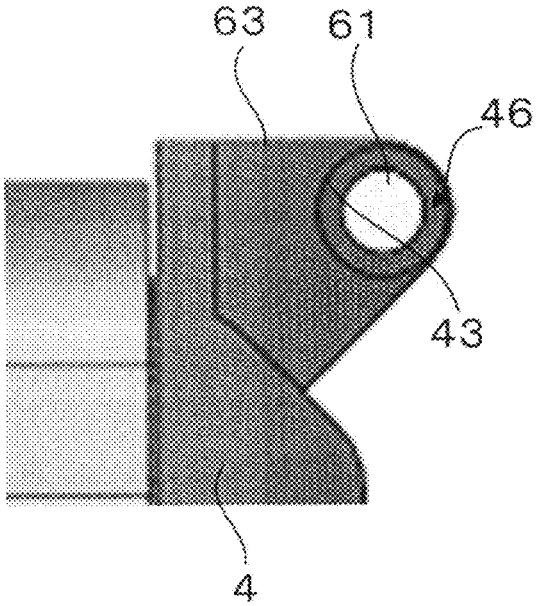
FIG. 3 is an upper view showing an inflexible fastener of the fasteners with which the reactor according to the first embodiment is provided.

As shown in FIG. 3, the inflexible fastener 63 is molded integrally with the resin mold 4. All portions of the inflexible fastener 63, namely from the protrusion base to the tip thereof, are made of a resin. In other words, the inflexible fastener 63 is made of a inflexible material. As a result, the inflexible fastener 63 is rigid and undeformable against an external force. The bolt hole 61 is made of only a resin. Alternatively, a metal ring collar that reinforces the bolt hole 61 may be buried therein. The material of the metal ring collar may be for example iron, stainless steel, brass, copper, or aluminum.

If the ring collar is used, it is preferred that the ring hole function as the bolt hole 61 and the periphery thereof be not coated with a resin, but be exposed. A resin tends to be cracked by a tightening force of the bolt. In addition, the bolt tends to get loosened due to heat creep.

If the periphery of the bolt hole 61 of the ring collar is not coated with a resin, but is exposed, a resin edge 43 is formed on the periphery of the bolt hole 61. The inside of the resin edge 43 becomes a recessed region 46 having the bolt hole 61. A ridge portion 22 that has the same size as the recessed region 46 is formed on the supporting member 2 corresponding to the position into which the bolt is screwed (refer to FIG.

1). When the ridge portion 22 is fit into the recessed region 46, the bolt hole 21 of the supporting member 2 and the bolt hole 61 of the fastener 6 can be easily aligned and thereby the main body 1 can be accurately secured to the supporting member 2.

(Operation)

The reactor is located in a harsh environment such as a vehicle where a large heat change occurs. If a large heat change occurs in the reactor, the gap between the main body 1 and the supporting member 2 changes due to the different linear expansion coefficients of the resin mold 4 and the metal supporting member 2. More specifically, the gap between the outer surface of the resin mold 4 and the inner wall surface of the supporting member 2 changes.

Figure 4:
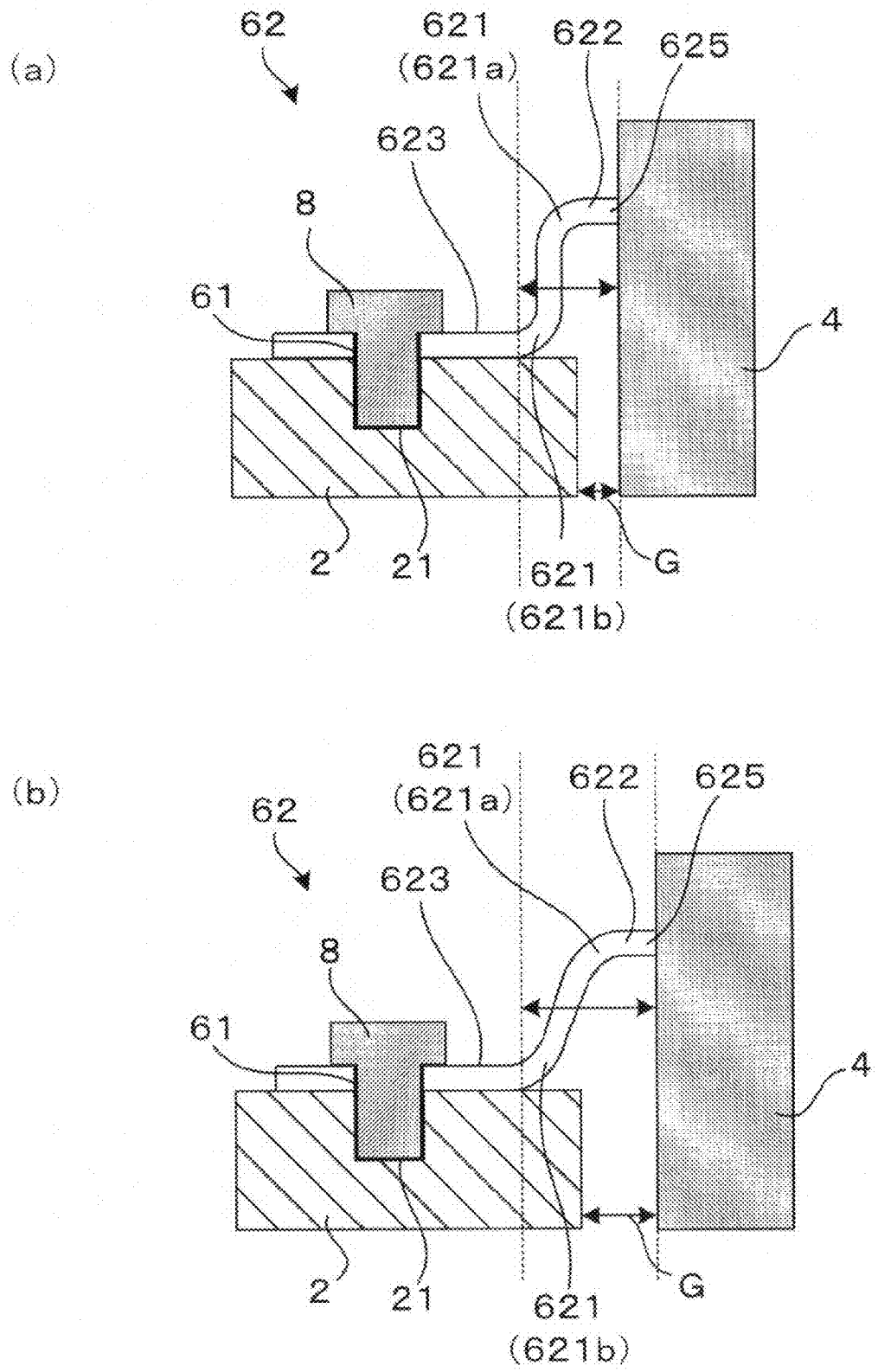
FIG. 4(*a*) and FIG. 4(*b*) are sectional views showing a flexible fastener of the reactor according to the first embodiment in which a large gap occurs therein.

However, in the reactor according to this embodiment as shown in FIG. 4, the flexible fastener 62 plastically deforms as the gap G increases such that a tensile stress imposed at the resin mold 4 decreases. If the flexible fastener 62 has the fold portion 621, as the gap G increases, a tensile stress that occurs in the flexible fastener 62 causes the fold portion 621 to plastically deforms such that the fold angle of the fold portion 621 decreases. As a result, the flexible fastener 62 expands as the gap G increases. Thereafter, the flexible fastener 62 does not impose the tensile stress at the resin mold 4.

Figure 5:
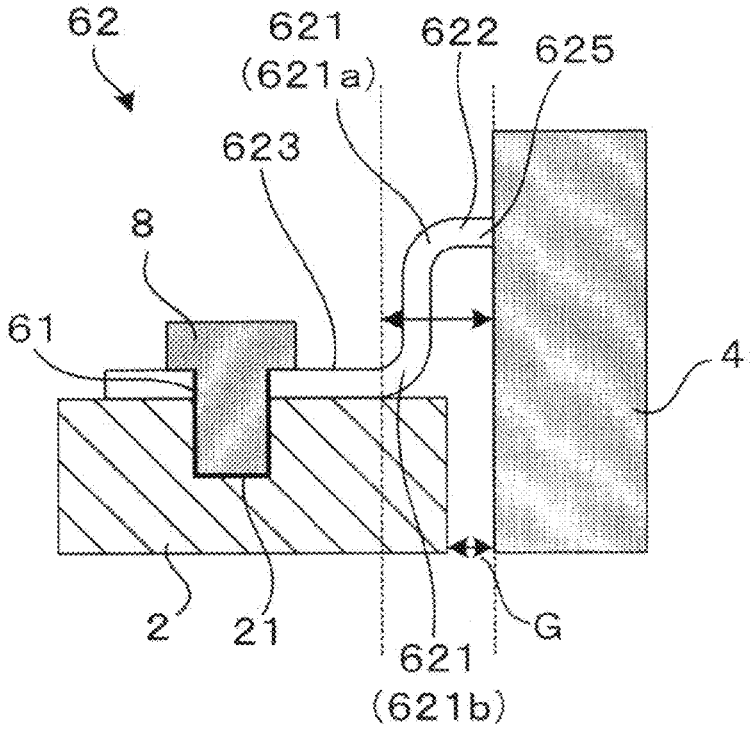
FIG. 5(*a*) and FIG. 5(*b*) are sectional views showing a flexible fastener of the reactor according to the first embodiment in which a small gap occurs therein.
Figure 5:
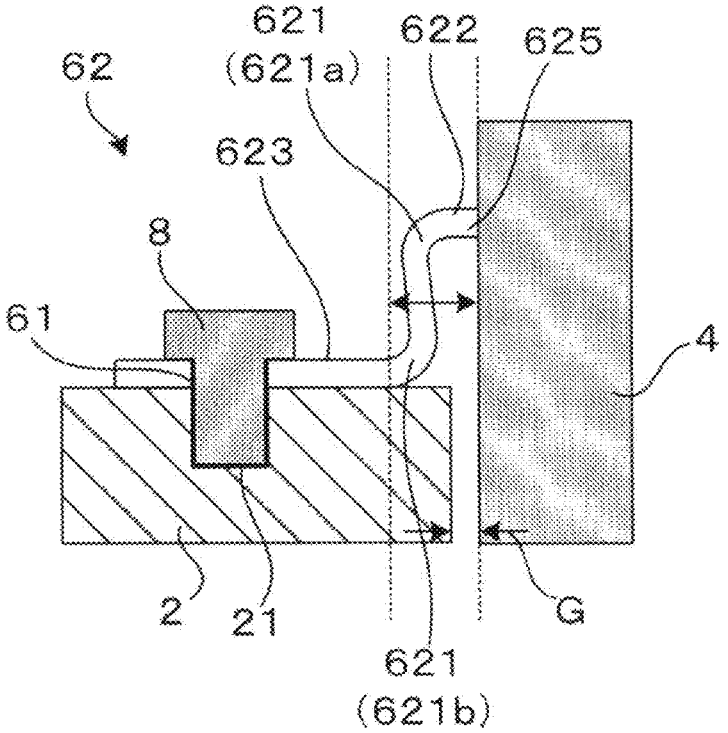

As shown in FIG. 5, as the gap G decreases, the flexible fastener 62 plastically deforms and shrinks such that a compression stress against the resin mold 4 decreases. If the flexible fastener 62 has the fold portion 621, as the gap G decreases, a compression stress that occurs in the flexible fastener 62 causes the fold portion 621 to plastically deform such that the fold angle of the fold portion 621 increases. As a result, the flexible fastener 62 shrinks as the gap G decreases. Thereafter, the flexible fastener 62 does not impose the compression stress at the resin mold 4.

As shown in FIG. 4 and FIG. 5, if the flexible fastener 62 has the fold portion 621 that has two folds, a tensile stress and a compression stress imposed at the fastening side horizontal portion 623 mainly deform the fastening side fold portion 621*b*. On the other hand, a tensile stress and a compression stress imposed at the base side horizontal portion 622 mainly deform the base side fold portion 621*a*. Thus, as the gap changes, the plate surface of the fastening side horizontal portion 623 and the base side horizontal portion 622 only move in the horizontal direction, but they are not forcedly bent. As a result, stresses hardly concentrate at the base 625 and the bolt hole 61 of the flexible fastener 62.

Figure 6:
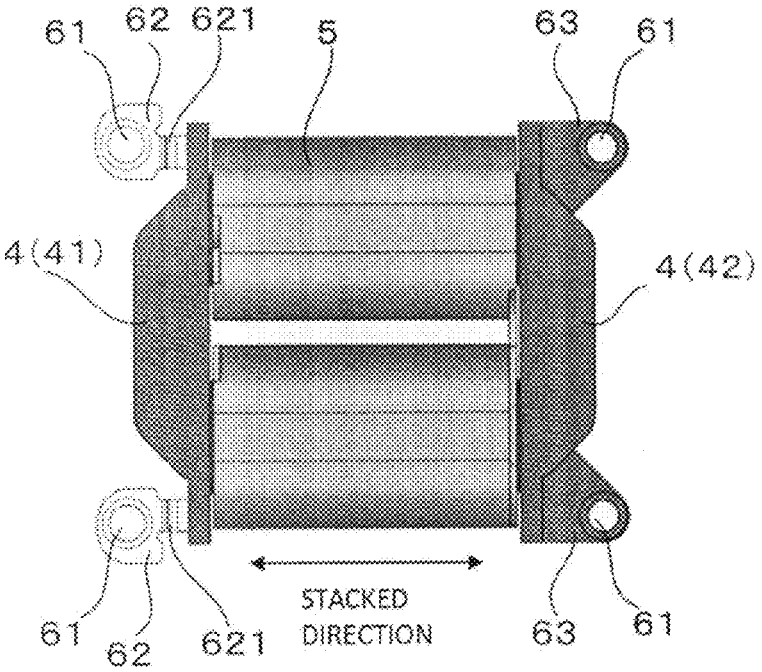
FIG. 6 is an upper view showing a reactor according to the first embodiment in which a gap change occurs therein.

In addition, as shown in FIG. 6, the flexible fastener 62 extends in the stacked direction of the magnetic blocks 31*a* and the spacers 32. In addition, the fold portion 621 is located such that it plastically deforms, namely shrinks and expands, in the stacked direction. Thus, the fold portion 621 can effectively absorb stresses imposed in the stacked direction and prevent the magnetic blocks 31*a* and the spacers 32 from being peeled off.

In addition, a gap change can be sufficiently absorbed on one end surface side of the resin mold 4. Thus, all the fasteners 6 may be the flexible fasteners 62. However, in the reactor according to this embodiment, the flexible fasteners 62 are located on one end surface of the resin mold 4, whereas the inflexible fasteners 63 are located on the other end surface of the resin mold 4. As a result, while the flexible fastener 62 can absorb a tensile stress and a compression stress due to a gap change that occurs, the inflexible fasteners 63 can improve the rigidity of the reactor.

(Effect)

In the reactor according to this embodiment, the resin mold 4 has a plurality of fasteners 6, at least one of which is the flexible fastener 62. The flexible fastener 62 has for example the fold portion 621 that becomes the start point of deformation. Thus, even if a gap change occurs due to different linear expansion coefficients of the resin mold 4 and the supporting member 2, the flexible fastener 62 deforms so as to absorb the gap change that occurs. As a result, a tensile stress and a compression stress imposed on the fastener 6 can be suppressed. Thus, since these stresses do not transfer to the resin mold 4 and the supporting member 2, they can be prevented from being broken.

In addition, the flexible fastener 62 has the fold portion 621 that has two folds the become the start point of deformation. The flexible fastener 62 horizontally protrudes from the resin mold 4 to the outside, folds two times, and then horizontally extends to the outside. Thus, it is unlikely that the horizontal portion of the flexible fastener 62 bends. As a result, stresses imposed at the base 625 and the bolt hole 61 of the flexible fastener 62 caused by the bending of the horizontal portion can be alleviated.

In addition to the flexible fasteners 62, the reactor according to this embodiment has the inflexible fastener 63. Thus, while the flexible fastener 62 can absorb a tensile stress and a compression stress due to a gap change that occurs, the inflexible fastener 63 can improve the rigidity of the reactor.

If the inflexible fastener 63 is formed of a resin integrated with the resin mold 4, since not only stresses imposed due to a gap change that occurs can be absorbed, but also the rigidity of the reactor can be improved without necessity to increase the number of parts, the cost performance can be improved.

The flexible fasteners 62 are located on one end surface side of the resin mold 4 such that they easily deform in the stacked direction of the magnetic blocks 31*a* and the spacers 32. The inflexible fasteners 63 are located on the other end surface side of the resin mold 4. As a result, the magnetic blocks 31*a* and the spacers 32 can be effectively prevented from peeling off.

Although most of the inflexible fasteners 63 are made of a resin, the resin edge 43 is formed on the periphery of the bolt hole 61 such that the recessed region 46 surrounds the bolt hole 61. On the other hand, in the supporting member 2, the ridge portion 22 having the same size as the recessed region 46 is formed and the bolt hole 21 is formed in the ridge portion 22. As a result, the bolt hole 61 and the bolt hole 21 can be easily aligned. In addition, the main body 1 can be accurately fit into the supporting member 2 and thereby the fragility of the reactor due to imperfect mounting can be alleviated.

Second Embodiment

Structure

A reactor according to a second embodiment of the present invention is different from that according to the first embodiment in flexible fasteners 62 and inflexible fasteners 63. According to the first embodiment, the flexible fastener 62 is made of a metal and is fully exposed from the protrusion base to the edge. On the other hand, the inflexible fastener 63 is molded integrally with the resin mold 4 except for the collar on the periphery of the bolt hole 61. In contrast, according to the second embodiment, the flexible fasteners 62 and the inflexible fasteners 63 are structured as follows.

Figure 7:
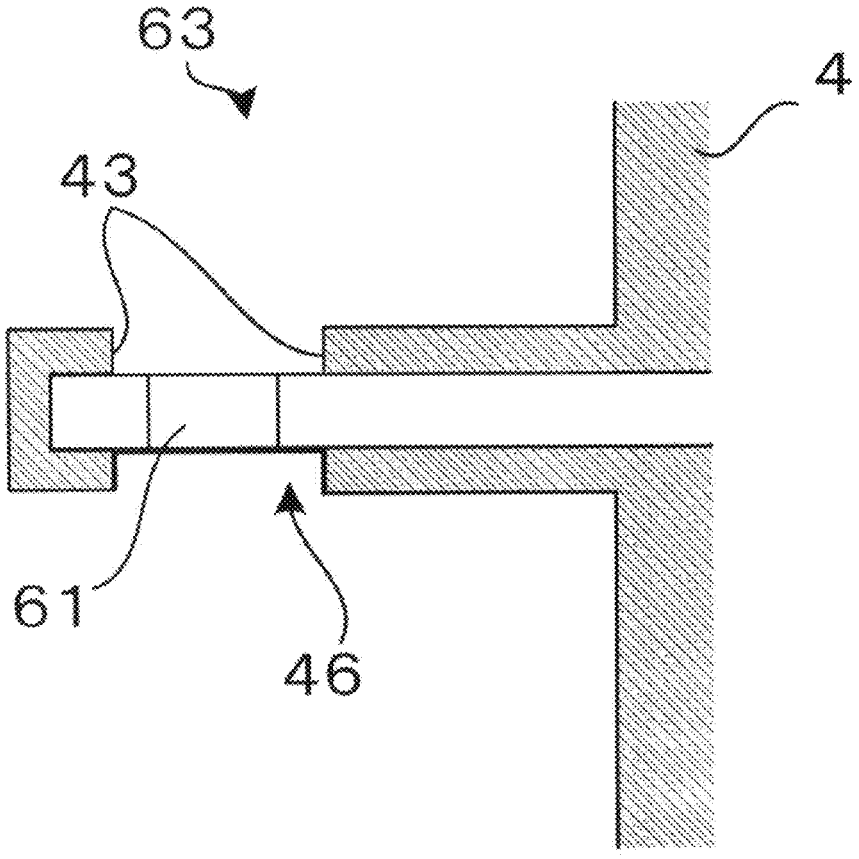
FIG. 7 is a sectional view showing an inflexible fastener with which a reactor according to a second embodiment of the present invention is provided.

As shown in FIG. 7, the inflexible fastener 63 has a metal plate frame that protrudes from an end surface of the resin mold 4. The inflexible fastener 63 is nearly fully coated with a resin formed integrally with the resin mold 4. The metal frame is set as an insert in the die of the resin mold 4.

It is preferred that the inner peripheral surface of the bolt hole 61 and the peripheral region be exposed, not coated with a resin. As a result, since the recessed region 46 formed by the resin edge 43 has the bolt hole 61, when the recessed region 46 is fit into the ridge portion 22 of the supporting member 2, the bolt hole 21 of the supporting member 2 and the bolt hole 61 of the inflexible fastener 63 can be easily aligned. Alternatively, the resin edge 43 may be formed such that it coats only a part of the periphery of the bolt hole 61 and the edge of the inflexible fastener 63 may be exposed from the resin.

Figures 8, 9:
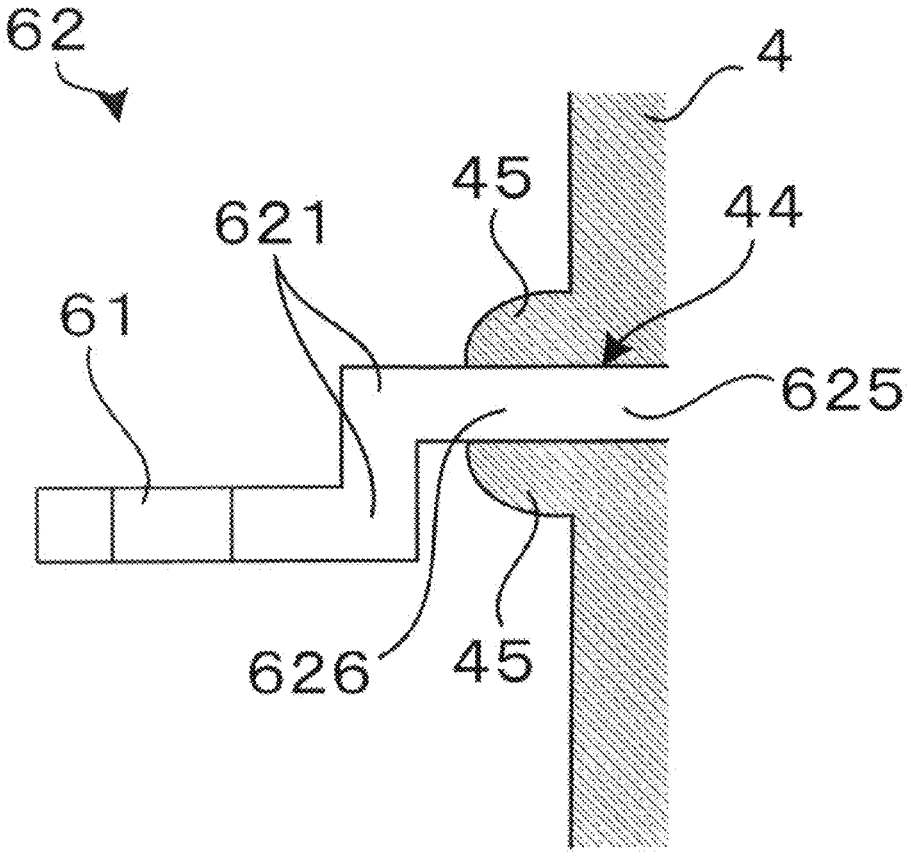
FIG. 8 is a sectional view showing a flexible fastener with which the reactor according to the second embodiment is provided.
FIG. 9 is a table showing stresses imposed at the reactor according to the second embodiment.

As shown in FIG. 8, the base 625 of the flexible fastener 62 is coated with the resin formed integrally with the resin mold 4. In other words, a part of the flexible fastener 62 is a fixed portion 626 that does not freely deform. The fixed portion 626 is formed of the resin integrated with the resin mold 4. The fixed portion 626 is formed at the base 625 that protrudes from the resin mold 4. Viewed from the resin mold 4, a base coat portion 45 that coats the base 625 of the flexible fastener 62 with the resin is molded integrally with the boundary portion 44 that contracts the base 625 of the flexible fastener 62 such that the resin mold 4 is connected to the boundary portion 44.

The fixed portion 626 further alleviates stresses that occur due to an external impact load imposed on the reactor and that concentrate at the base 625 of the flexible fastener 62 and the boundary portion 44 of the resin mold 4 such that the stresses do not break the base 625 and the boundary portion 44. In other words, the resin portion of the fixed portion 626 becomes an extra bump that occurs at the boundary portion 44 of the resin mold 4, that increases the thickness of the base 625 of the flexible fastener 62 and the boundary portion 44 of the resin mold 4 and that alleviates the stresses that concentrate.

(Operation)

The reactor according to this embodiment was vibrated in various directions. A distribution of stresses that were imposed on the reactor was analyzed using an analysis software application.

FIG. 9 is a table that lists stress values obtained from the analysis. First, the reactor was vibrated in the upper and lower direction, namely the direction perpendicular to the flat surface of the flexible fastener 62. At this point, stresses concentrated at the base 625 of the flexible fastener 62 and the boundary portion 44 of the resin mold 4. If the base 625 of the flexible fastener 62 was not coated with the resin, a stress of 110.9 MPa concentrated at the boundary portion 44 of the resin mold 4 and a stress of 337.3 MPa concentrated at the base 625 of the flexible fastener 62.

In contrast, according to this embodiment, the base 625 of the flexible fastener 62 is the fixed portion 626 that is coated with the resin formed integrally with the resin mold 4. As a result, the stress that concentrated at the boundary portion 44 decreased to 78.9 MPa. The stress that concentrated at the base 625 decreased to 330.1 MPa. The decrease ratio of the stress that concentrated at the flexible fastener 62 was 2.1%. The decrease ratio of the stress that concentrated at the resin mold 4 was 28.9%.

Thereafter, vibrations in the longitudinal direction, namely the pulling force and the pushing force, were alternately and successively applied to the flexible fastener 62. At this point, when the base 625 of the flexible fastener 62 was not coated with the resin, a stress of 310.7 MPa concentrated at the boundary portion 44 of the resin mold 4, whereas a stress of 739.3 MPa concentrated at the base 625 of the flexible fastener 62.

In contrast, according to this embodiment, the base 625 of the flexible fastener 62 is the fixed portion 626 that is coated with the resin formed integrally with the resin mold 4. As a result, the stress that concentrated at the boundary portion 44 decreased to 108.5 MPa. The stress that concentrated at the base 625 of the flexible fastener 62 decreased to 193.9 MPa. The decrease ratio of the stress that concentrated at the fasteners 6 was 73.8%. The decrease ratio of the stress that concentrated at the boundary portion 44 was 65.1%.

Thereafter, vibrations in the width direction where the flexible fastener 62 was twisted were applied. When the base 625 of the flexible fastener 62 was not coated with the resin, a stress of 180.2 MPa concentrated at the boundary portion 44, whereas a stress of 469.7 MPa concentrated at the base 625.

In contrast, according to this embodiment, since the base 625 of the flexible fastener 62 was the fixed portion 626 that is coated with the resin formed integrally with the resin mold 4. As a result, the stress that concentrated at the boundary portion 44 decreased to 81.8 MPa. The stress that concentrated at the base 625 decreased to 132.3 MPa. The decrease ratio of the stress that concentrated at the base 625 was 71.8%. The decrease ratio of the stress that concentrated at the boundary portion 44 was 54.6%.

(Effect)

As described above, in the reactor according to this embodiment, a part of the flexible fastener 62 is the fixed portion 626 that does not freely plastically deform against vibrations. The fixed portion 626 is located at a position at which stresses caused by vibrations tend to concentrate. For example, the fixed portion 626 is the base 625 of the flexible fastener 62 that protrudes from the resin mold 4.

Thus, since stresses that concentrate at the base 625 of the flexible fastener 62 and the boundary portion 44 of the resin mold 4 that contacts the base 625 are alleviated, cracks that tend to occur at the joint portion of the resin mold 4 and the flexible fastener 62 can be prevented.

In addition, the fixed portion 626 is formed such that the base 625 of the flexible fastener 62 is coated with the resin integrated with the resin mold 4. In other words, the fixed portion 626 can be formed as the resin mold 4 is formed without need to modify the metal frame as the flexible fastener 62. Thus, the base 625 of the flexible fastener 62 can be used as the fixed portion 626 without need to increase the number of manufacturing steps and the number of parts. As a result, the final product can be easily manufactured without necessity to increase of the cost.

Third Embodiment

Structure

In the reactors according to the first and second embodiments, plastic deformation of the flexible fastener 62 absorbs a gap change that occurs between the resin mold 4 and the supporting member 2 so as to prevent a tensile stress and a compression stress from affecting the resin mold 4. In other words, in the reactors according to the present invention, the connection mechanism of the resin mold 4 and the supporting member 2 absorbs a gap change that occurs. In a reactor according to a third embodiment of the present invention, the connection mechanism of the resin mold 4 and supporting member 2 is different from those according to the first and second embodiments in absorbing of a gap change.

Figure 10:
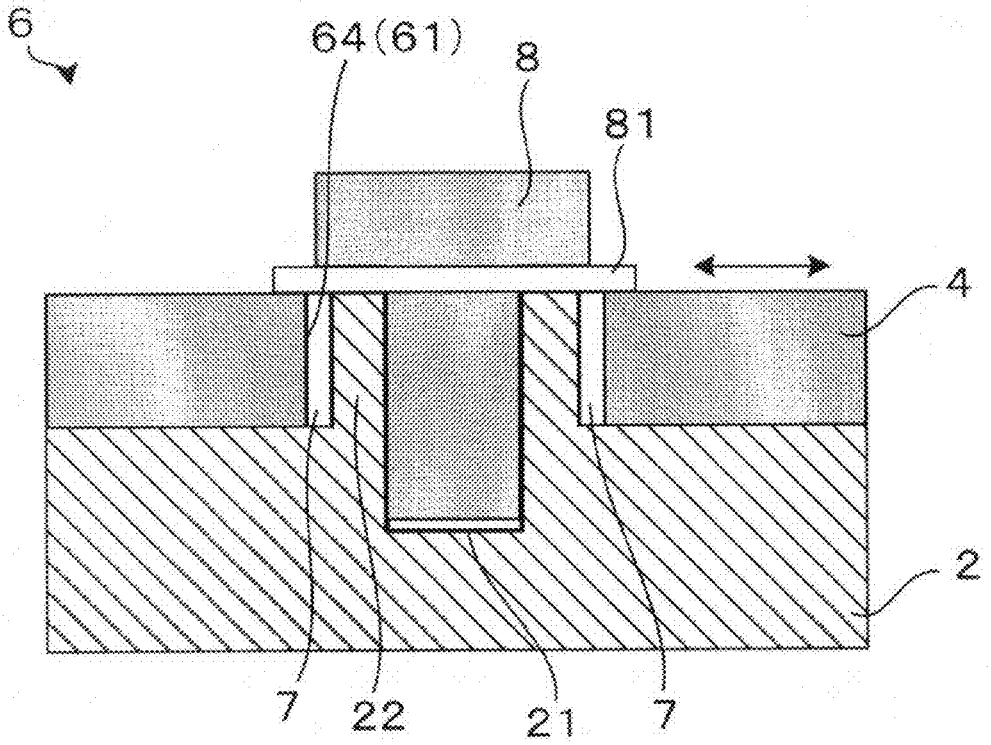
FIG. 10 is an enlarged view showing a fastening position of a fastener with which a reactor according to a third embodiment of the present invention is provided.

In the reactor according to the third embodiment, the fastener 6 is relatively movable against the supporting member 2. As shown in FIG. 10, in the direction of which the gap increases or decreases, the fastener 6 can be moved in a predetermined range. In the predetermined range, a flange 81 presses the fastener 6 to the supporting member 2. The direction of which the gap increases or decreases is that of which the edge of the supporting member 2 faces the surface of the resin mold 4. As shown in FIG. 10, the predetermined range is also a space formed between the inner peripheral surface of a hole 64 of the fastener 6 and the outer peripheral surface of the insertion portion of the hole 64, namely a free space 7. In the free space 7, the fastener 6 slidably moves on the supporting member 2.

Specifically, as shown in FIG. 10, the hole 64 is formed at the edge of the fastener 6 such that the hole 64 pierces the front and rear of the fastener 6. The hole 64 may be formed in a circular shape that is greater than the ridge portion 22 or an ellipse shape that extends in the longer side direction of the resin mold 4.

Formed on an edge surface of the supporting member 2 is a ridge portion 22 having a bolt hole 21. The diameter of the ridge portion 22 is smaller than that of the hole 64 such that the ridge portion 22 is fit into the hole 64. Thus, when the ridge portion 22 is fit into the hole 64, the free space 7 is formed between the inner peripheral surface of the hole 64 and the ridge portion 22. The depth of the hole 64 is nearly the same as or nearly greater than the height of the ridge portion 22.

A bolt 8 inserted into the fasteners 6 has a diameter for which the bolt 8 that is fit into the bolt hole 21 of the supporting member 2. However, the diameter of the bolt 8 is smaller than that of the hole 64 of the fastener 6. A flange 81 that spreads in the horizontal direction is formed at the head of the bolt 8. The protrusion length of the flange 81 is greater than the diameter of the hole 64 of the fastener 6.

(Operation)

In the reactor according to this embodiment, the ridge portion 22 of the supporting member 2 is fit into the hole 64 of the fastener 6. The bolt 8 is inserted into the hole 64 of the fastener 6. The bolt 8 is screwed into the bolt hole 21 of the supporting member 2 until the edge of the hole 64 contacts the flange 81. As a result, the main body 1 is connected to the supporting member 2. In other words, the ridge portion 22 and the bolt 8 are inserted into the hole 64.

In this state, since the flange 81 presses the edge of the hole 64, the ridge portion 22 does not drop from the hole 64. In other words, even if vibrations occur, the resin mold 4 does not drop from the accommodation space of the supporting member 2.

Thus, as long as the flange 81 presses the fastener 6, the shapes of the flange 81, the hole 64, and the ridge portion 22 do not need to be limited. For example, the diameter of the flange 81 may be greater than that of the hole 64 and the flange 81 may hang from the ridge portion 22 and contact the edge of the hold 64.

In this reactor, the free space 7 is formed between the inner peripheral surface of the hole 64 and the outer peripheral surface of the ridge portion 22. In other words, there is a relatively movable space between the hole 64 and the ridge portion 22. Thus, if a gap change occurs, since the hole 64 of the fasteners 6 and the ridge portion 22 of the supporting member 2 relatively move, large tensile stress and compression stress are not imposed on the fasteners 6. In addition, the large tensile stress and compression stress do not affect the resin mold 4.

Although the flange 81 presses the fastener 6, it is movable between the flange 81 and the supporting member 2. Thus, although the fastener 6 can be made of a metal or a resin, it is preferred that the fastener 6 be made of a resin from a view point of slidability.

(Effect)

In the reactor according to this embodiment, the hole 64 is formed in the fastener 6. The ridge portion 22 that is smaller than the hole 64 is formed on the supporting member 2. When the ridge portion 22 of the supporting member 2 is fit into the hole 64 of the fasteners 6, the hole 64 and the ridge portion 22 are connected such that they are relatively movable. According to this embodiment, a tensile stress and a compression stress that occur due to a gap change are not imposed on the fastener 6. As a result, since these stresses do not affect the resin mold 4 and the supporting member 2, they can be prevented from being broken.

The bolt 8 has the flange 81 that is longer than the diameter of the hole 64 of the fasteners 6. The flange 81 presses the edge of the hole 64 and the bolt 8 is inserted into the bolt hole 21 of the ridge portion 22. As a result, the flange 81 can function as a retainer. Thus, while the hole 64 and the ridge portion 22 are slidable, the main body 1 and the supporting member 2 are not disconnected.

Fourth Embodiment

Structure

Figure 11:
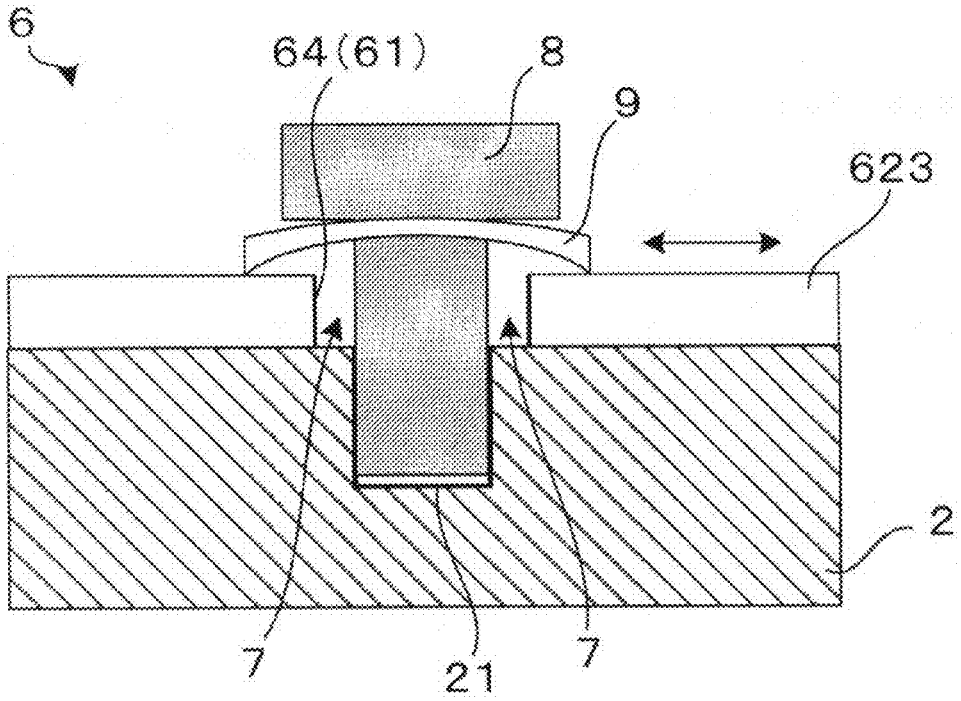
FIG. 11 is an enlarged view showing a fastening position of a fastener with which a reactor according to a fourth embodiment of the present invention is provided.
Figure 12:
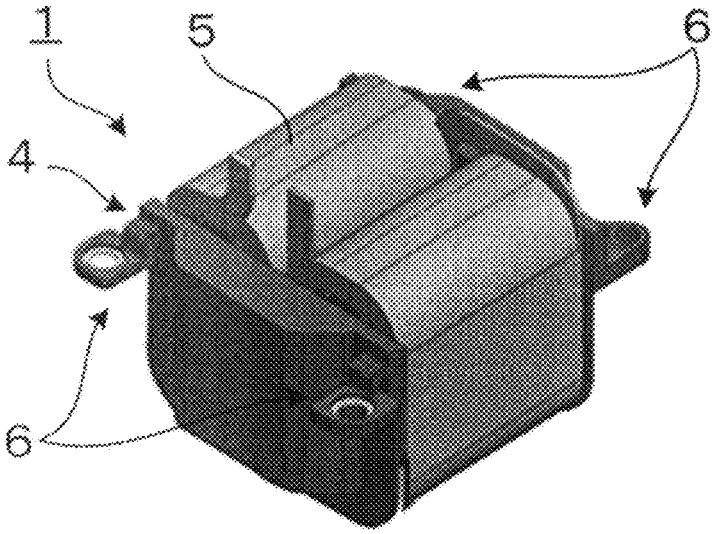
FIG. 12 is a schematic diagram showing a final product of a reactor according to another embodiment of the present invention.

A fourth embodiment of the present invention is different from the third embodiment of the present invention in the bolt 8. According to the third embodiment, the supporting member 2 has the ridge portion 22. In contrast, as shown in FIG. 11, according to the fourth embodiment, the supporting member 2 does not have the ridge portion 22. In addition, a free space 7 is formed between the inner peripheral surface of the hole 64 of the fastener 6 and the outer peripheral surface of the bolt 8. A disc spring 9 is located between the head of the bolt 8 and the edge of the hole 64 of the fastener 6 so as to press the edge of the hole 64.

Specifically, formed at an edge surface of the supporting member 2 is a bolt hole 21. Although the hole 64 of the fastener 6 may be formed in a circular shape or an elliptic shape, the diameter of the hole 64 is greater than the diameter of the bolt 8. The head of the bolt 8 does not directly press the edge of the hole 64 of the fastener 6. Thus, the head of the bolt 8 does not need to have a protrusion length greater than the diameter of the hole 64.

The disc spring 9 is a cup-shaped spring having a vertex where a bolt hole is formed. The diameter of the edge of the disc spring 9 is greater than the diameter of the hole 64 of the fastener 6. The disc spring 9 is located such that it covers the hole 64 of the fastener 6. The edge of the disc spring 9 is located around the hole 64 of the fastener 6.

The bolt 8 is screwed into the bolt hole 21 of the supporting member 2 through the vertex of the disc spring 9 and the hole 64. At this point, the disc spring 9 is subject to a flattening pressure from the lower surface of the head at the vertex and thereby the edge of the disc spring 9 presses the fastener 6.

(Operation)

In the reactor according to this embodiment, the head of the bolt 8 presses the disc spring 9. Thus, the disc spring 9 presses the edge of the hole 64. As a result, the resin mold 4 does not drop from the hole 64. In other words, as long as the disc spring 9 is subject to a pressure from the lower surface of the head of the bolt 8 and transfers the pressure to the edge of the hole 64, the shape, material, and elastic force of the disc spring 9 are not limited. The disc spring 9 is for example a wave washer.

In the reactor according to this embodiment, the free space 7 is formed between the inner peripheral surface of the hole 64 and the outer peripheral surface of the bolt 8. In other words, there is a space in which the bolt 8 and the hole 64 can relatively move. Thus, if a gap change occurs, the hole 64 of the fastener 6 relatively moves against the bolt 8. As a result, a large tensile stress and a large compression stress are not imposed on the fastener 6. Consequently, the large tensile stress and the large compression stress are not affected to the resin mold 4.

The disc spring 9 restricts the motion of the disc spring 9. Thus, the fastener 6 can more easily slide and move than the third embodiment. As a result, the fastener 6 can effectively operate regardless of whether it is made of a metal or a resin.

(Effect)

In the reactor according to this embodiment, the hole 64 is formed in the fastener 6. The bolt 8 whose diameter is smaller than that of the hole 64 is screwed into the supporting member 2. In addition, the resin mold 4 and the supporting member 2 are connected such that the hole 64 and the bolt 8 are relatively movable. According to this embodiment, a tensile stress and a compression stress that occur due to a gap change are not imposed on the fastener 6. As a result, since these stresses do not affect the resin mold 4 and the supporting member 2, they can be prevented from being broken.

In the reactor according to this embodiment, the cup-shaped disc spring 9 is located between the head of the bolt 8 and the edge of the hole 64 such that the disc spring 9 pressed by the head of the bolt 8 presses the edge of the hole 64. As a result, the disc spring 9 can function as a retainer and a cushion material. Thus, while the hole 64 and the bolt 8 are slidable, the main body 1 and the supporting member 2 are not disconnected.

The flange 81 according to the third embodiment and disc spring 9 according to the fourth embodiment function as retainers. Thus, even if the flange 81 or the disc spring 9 is not provided, the fastener 6 and the supporting member 2 can relatively move in the free space 7 in the direction where the gap increases or decreases and thereby the gap change that occurs due to the different linear expansion coefficients of the fastener 6 and the supporting member 2 can be absorbed.

Other Embodiments

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

As long as the resin mold 4 can be secured to the supporting member 2, the number and positions of fasteners 6 are not limited to those as described in the foregoing embodiments. In other words, the fasteners 6 may be located at four corners (two corners on each end) of the resin mold 4 or equally located at eight positions on four sides of the resin mold 4. In addition, the ratio and positions of the flexible fasteners 62 and inflexible fasteners 63 can be appropriately changed from those described in the foregoing embodiments. For example, the fasteners 6 may be only flexible fasteners 62. Alternatively, only one flexible fastener 62 may be located on one end, one or more inflexible fasteners 63 on the other end. Alternatively, three or four flexible fasteners 62 may be located at one end surface from a view point of balancing of gap change, rigidity, and stability.

According to each of the foregoing embodiments, the flexible fasteners 62 are located on one end of the resin mold 4 such that the flexible fasteners 62 can deform in the stacked direction of the magnetic blocks 31*a* and the spacers 32 and prevent them from peeling off. The inflexible fasteners 63 are located on the other end of the resin mold 4. However, the present invention is not limited to such embodiments. For example, the flexible fasteners 62 may be located in the direction where a gap change that occurs between the main body 1 and the supporting member 2 is the largest. If the length of the main body 1 is greater than the height and width thereof and a gap change that occurs in the length direction is large, the flexible fasteners 62 may be located in the length direction such that the flexible fasteners 62 can easily deform.

The flexible fastener 62 may be made of a resin or another material other than a metal as long as the flexible fastener 62 can absorb a gap change that occurs due to the different linear expansion coefficients. The shape of the flexible fastener 62 may be a U-letter bellows shape (one fold), a W-letter bellows shape (two folds), an L-letter shape, or a mountain shape. The shape of the flexible fastener 62 can be changed depending on how the main body 1 and the supporting member 2 are secured.

The inflexible fastener 63 may be made of a resin or a metal as long as the inflexible fastener 63 is inflexible. The inflexible fastener 63 may be made of a metal as long as the inflexible fastener 63 has a thickness for which a gap change does not cause the inflexible fastener 63 to deform or the inflexible fastener 63 is reinforced. Alternatively, the inflexible fastener 63 may have a deformation resistance shape.

Alternatively, the fixed portion 626 that does not freely deform of the flexible fastener 62 may be a resin-coated portion, a thick portion, or a portion having a structure different from the rest. The shape of the resin that coats the base of the flexible fastener 62 is not limited to the foregoing as long as it is an extra bump. Alternatively, the shape of the resin may have a sophisticated aesthetic. The base coat portion 45 that coats the base 625 may be tapered depending on stresses imposed on the flexible fastener 62. The base coat portion 45 may be gradually tapered from the base 625 toward the tip. Alternatively, the base coat portion 45 may be tapered with a plurality of stages. Alternatively, the base coat portion 45 may be linearly tapered. Alternatively, the base coat portion 45 may have a predetermined thickness.

In the foregoing embodiments, the main body 1 and the supporting member 2 are secured by the fasteners 6. Alternatively, after the main body 1 is placed into an accommodation space of the supporting member 2, they may be secured with an insulative resin. Alternatively, the fasteners 6 may be secured with an adhesive agent.

The material of the supporting member 2 is not limited to the foregoing as long as it is different from that of the main body 1 and their linear expansion coefficients are different from each other. Since the main body 1 encloses the resin mold 4 and the core 3, the linear expansion coefficient of the main body 1 may be 10 to $15\times10^{-6}$. In this case, the supporting member 2 can be made of a material whose linear expansion coefficient is different from that linear expansion coefficient. If the supporting member 2 is made of aluminum, it has a linear expansion coefficient of 20 to $25\times10^{-6}$.

The supporting member 2 may be for example an enclosure that surrounds four sides and a bottom surface or a bracket made of a U-shaped plate that does not have a side wall. Alternatively, the straight portions 31 of the core 3 may be cuboids having a square section or cylinders having a circular section.

Another Embodiment

Next, a reactor according to another embodiment of the present invention will be described. Fasteners 6 are set as inserts in a die of a resin mold 4. The die is filled with a resin. As a result, the fasteners 6 are formed integrally with the resin mold 4.

Figure 13:
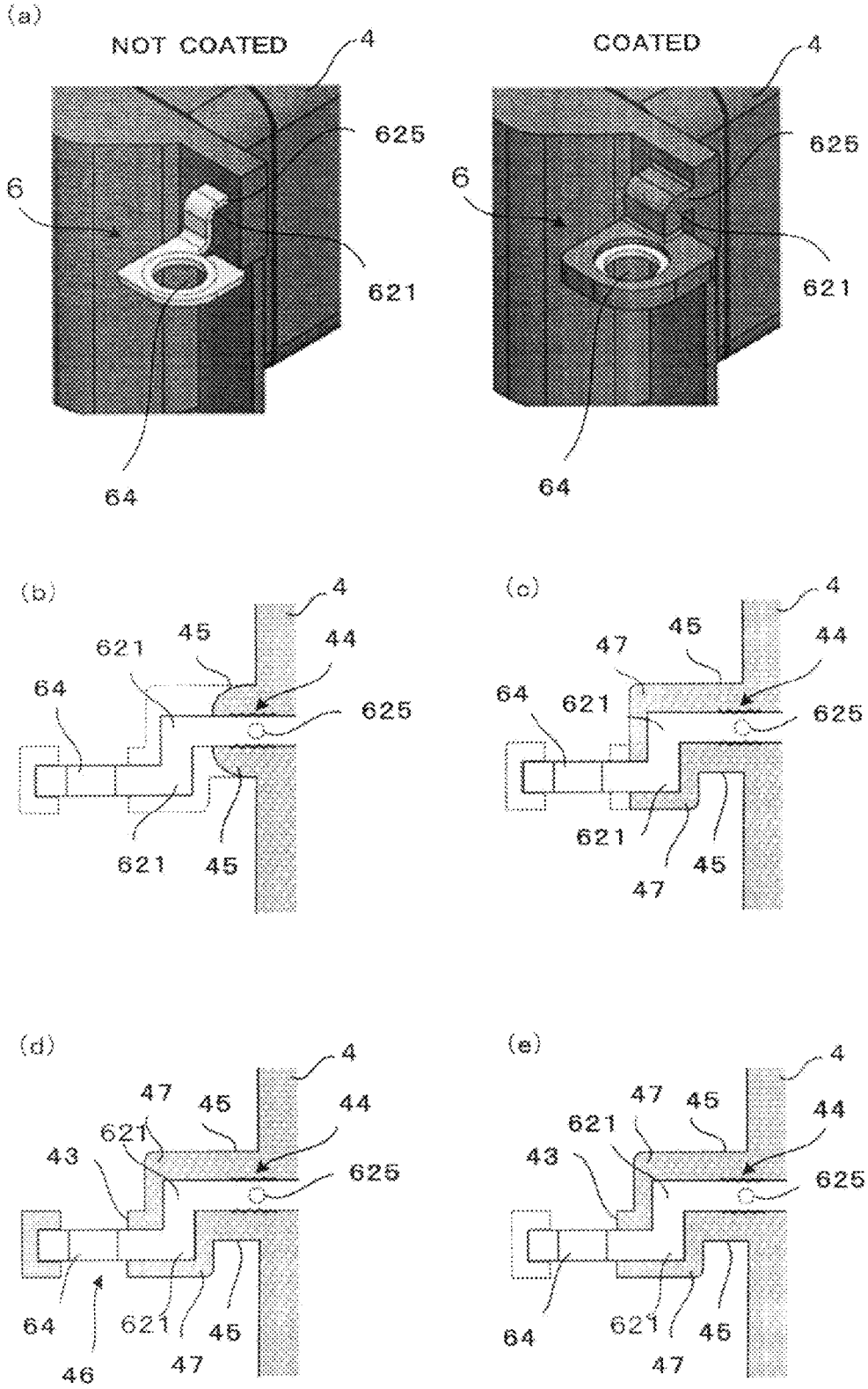
FIG. 13(*a*) shows fasteners of the reactor according to another embodiment, one fastener being coated with a resin and another fastener not being coated with a resin.

As shown in FIG. 13, in the fastener 6, a base 625 protrudes from a side surface of the resin mold 4. A portion that extends from the base 625 of the fastener 6 is coated with a resin formed integrally with the resin mold 4. The resin alleviates stresses that concentrate at the fastener 6. The stresses concentrate where materials or shapes discontinuously change. In the reactor, stresses tend to concentrate for example at the base 625 of the fastener 6, the fold portion 621 of the fastener 6, and the boundary portion 44 of the resin mold 4 that contacts the base 625 of the fastener 6. The resin formed integrally with the resin mold 4 allows the materials and shapes to be gradually changed or the thickness of the fastener 6 to gradually increase, thereby alleviates the stresses that concentrate.

(Structure)

As shown in FIG. 13(*a*)(right), most of the fastener 6 is coated with a resin formed integrally with the resin mold 4. The resin that coats the fastener 6 depends on its function. Thus, the position at which the resin is coated may depend on the selected function of the fastener 6.

As shown in FIG. 13(*b*), the resin formed integrally with the resin mold 4 coats the base 625 of the fastener 6. In other words, the resin mold 4 has a base coat portion 45 that coats the base 625 of the fastener 6 with the resin. The base coat portion 45 is formed integrally with the boundary portion 44 of the resin mold 4. In the resin mold 4, the boundary portion 44 contacts the base 625 of the fastener 6.

As shown in FIG. 13(*c*), if the fastener 6 has the fold portion 621, it may be coated with the resin formed integrally with the resin mold 4. In other words, the resin mold 4 has a fold region coat portion 47 that coats the fold portion 621 of the fastener 6 with the resin.

According to this embodiment, the fastener 6 horizontally protrudes from a side surface of the resin mold 4 to the outside, folds two times, and horizontally extends to the outside so as to form a stage. In this fastener 6, the side surface of the resin mold 4 is apart from the fold portion 621 of the fastener 6. In other words, the fold region coat portion 47 is formed with the resin integrated with the base coat portion 45 and the boundary portion 44 of the resin mold 4.

The base coat portion 45 and the fold region coat portion 47 alleviate stresses that are caused by an external impact load imposed on the reactor and that concentrate at the base 625 of the fastener 6, the boundary portion 44 of the resin mold 4, and the fold portion 621 of the fastener 6 and prevent them from being broken.

In other words, the base coat portion 45 becomes an excess bump that occurs at the boundary portion 44 of the resin mold 4, increases the thicknesses of the base 625 of the fastener 6 and the boundary portion 44 of the resin mold 4, and thereby alleviates the stresses that concentrate. The fold region coat portion 47 increases the radius of curvature of the fold portion 621 of the fastener 6 and increases the thickness of the fold portion 621 so as to alleviate stresses that concentrate.

However, as shown in FIG. 13(*d*) and FIG. 13(*e*), it is preferred that the inner peripheral surface and the peripheral region of the hole 64 be exposed, not coated with the resin. A resin tends to be cracked by a tightening force of the bolt. In addition, the bolt tends to get loosened due to heat creep.

If the periphery of the hole 64 is not coated with a resin and the outer periphery thereof is coated with a resin having a predetermined thickness, a resin edge 43 is formed on the periphery of the hole 64. As a result, the fastener 6 is partitioned by the resin edge 43 and thereby a recessed region 46 that has the hole 64 is formed.

When the ridge portion 22 is fit into the recessed region 46, the bolt hole 21 of the supporting member 2 and the hole 64 of the fastener 6 can be easily aligned and thereby the main body 1 can be accurately secured to the supporting member 2.

As shown in FIG. 13(*d*), the edge 43 may be formed such that it coats all the periphery of the hole 64. The fastener 6 may be fully coated with the resin from the base to the tip except for the recessed region 46. Alternatively, as shown in FIG. 13(*e*), the edge 43 may be formed such that it coats only a part of the periphery of the hole 64. A tip side region that extends from the edge 43 of the fastener 6 may be exposed, not coated with the resin. The tip side region that is not coated with the resin and that extends from the edge 43 sufficiently contributes to the fitting of the ridge portion 22. This region could be a recessed region 46 according to this embodiment.

(Operation)

The reactor according to this embodiment was vibrated in various directions. A distribution of stresses that were imposed on the reactor was analyzed using an analysis software application. Since the result was the same as that obtained in the second embodiment (FIG. 9), the description will be omitted.

(Effect)

As is clear from the result, in the reactor according to this embodiment, the fasteners 6 that secure the supporting member 2 and the resin mold 4 are formed as inserts integrated with the resin mold 4 such that the fasteners 6 protrude from side surfaces of the resin mold 4. The base 625 that protrudes from the fastener 6 is coated with the resin formed integrally with the resin mold 4. Thus, since stresses that concentrate at the base 625 of the fastener 6 and the resin mold 4 that contacts the base 625 are alleviated, cracks that tend to occur at the joint portion of the resin mold 4 and the fastener 6 can be prevented.

If the fastener 6 has the fold portion 621, the region from the base 625 to the fold portion 621 of the fastener 6 is coated with the resin formed integrally with the resin mold 4. As a result, stresses that concentrate at the fold portion 621 of the fastener 6 are alleviated. Consequently, the fold portion 621 can be prevented from being weakened by metal fatigue and thereby the fastener 6 from being broken.

In addition, most of the fastener 6 is coated with the resin formed integrally with the resin mold 4. As a result, the boundary portion 44 of the resin mold 4, the base 625 of the fastener 6, and the fold portion 621 of the fastener 6 can be easily prevented from being cracked and being weakened by metal fatigue. In particular, they have a resistance against vibrations that cause the reactor to twist.

Located at the tip of the fastener 6 is the hole 64 for a bolt. At this point, most of the fastener 6 is coated with the resin formed integrally with the resin mold 4 except for the hole 64 and its periphery such that the resin has a predetermined thickness. As a result, the recessed region 46 that contacts the hole 64 is formed with the resin. Located on the supporting member 2 is the ridge portion 22 having the same size as the recessed region 46. Formed in the ridge portion 22 is the bolt hole 21 for the bolt.

As a result, the boundary portion 44 of the resin mold 4, the base 625 of the fastener 6, and the fold portion 621 of the fastener 6 can be easily prevented from being cracked and being weakened by metal failure. In addition, the supporting member 2 and the main body 1 can be easily and accurately aligned and thereby it is unlikely that the fragility caused by improper mounting will occur.

DESCRIPTION OF REFERENCE NUMERALS

1 Main body
2 Supporting member

21 Bolt hole
22 Ridge portion
3 Core
31 Straight portions
31*a* Magnetic blocks
32 Spacers
4 Resin mold
41 First separate member
42 Second separate member
43 Edge
44 Boundary portion
45 Base coat portion
46 Recessed region
47 Fold region coat portion
5 Coil
6 Fastener
61 Bolt hole
62 Flexible fastener
621 Fold portion
621*a* Base side fold portion
621*b* Fastening side fold portion
622 Base side horizontal portion
623 Fastening side horizontal portion
624 Vertical portion
625 Base
626 Fixed portion
63 Inflexible fastener
64 Hole
7 Free space
8 Bolt
81 Flange
9 Disc spring
G Gap Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A reactor, comprising:

a core made of a magnetic material;

a resin mold that encloses said core;

a coil that is wound around said core through said resin mold; a plurality of fasteners located on said resin mold; and a supporting member that is secured to said resin mold through said fasteners, wherein at least one of said plurality of fasteners is a flexible fastener, and wherein said flexible fastener has a fold portion having two folds, the fold portion including a first portion that, horizontally protrudes from said resin mold to an outside in a direction away from the resin mold, the fold portion folding two times, and the fold portion further including a second portion horizontally extending further in the direction away from the resin mold to the outside than the first portion wherein said flexible fastener is coated with the resin formed integrally with said resin mold wherein said flexible fastener has a hole, wherein a recessed region is formed such that said flexible fastener except the said hole and a periphery thereof is coated with a resin, and wherein said recessed region is formed by a resin edge that surrounds all the periphery of said hole.

2. The reactor as set forth in claim 1, wherein said flexible fastener has a fold portion that becomes a start point of deformation.

3. The reactor as set forth in claim 1, wherein said plurality of fasteners include an inflexible fastener besides said flexible fastener.

4. The reactor as set forth in claim 3, wherein said inflexible fastener is coated with the resin formed integrally with said resin mold.

5. The reactor as set forth in claim 3, wherein said inflexible faster is made of the resin integrated with said resin mold.

6. The reactor as set forth in claim 3, wherein said core is composed of magnetic blocks and spacers that are alternately stacked, wherein said flexible fastener is located in the stacked direction of said magnetic blocks and said spacers such that said flexible fastener easily deforms and on only one end of said resin mold, and wherein said inflexible fastener is located on only other end of said resin mold.

7. The reactor as set forth in claim 1, wherein a part of said flexible fastener is a fixed portion that does not freely deform.

8. The reactor as set forth in claim 7, wherein said fixed portion is coated with the resin formed integrally with said resin mold.

9. The reactor as set forth in claim 7, wherein said fixed portion is a base that becomes a protrusion base of said flexible fastener that protrudes from said resin mold.

10. The reactor forth in claim 3, wherein said inflexible fastener has a bolt hole at the tip and a recessed region connected to the bolt hole, the bolt hole being partitioned by an edge of the resin that surrounds at least a part of the periphery of said bolt hole, said recessed region being connected to the bolt hole, and wherein said supporting member has a bolt hole and a ridge portion having the same size as the recessed region such that when said ridge portion is fit into said recessed region, the bolt hole of said flexible fastener and the bolt hole of said supporting member are aligned.

11. A reactor, comprising:

a core made of a magnetic material;

a resin mold that encloses said core;

a coil that is wound around said core through said resin mold;

a plurality of fasteners located on said resin mold;

a supporting member that is connected to said resin mold through said fasteners; and a retainer member that presses said fasteners to said supporting member, wherein said fasteners are held by said supporting member and said retainer member so as to connect said resin mold and said supporting member through said fasteners and relatively slide said fasteners against said supporting member, wherein each of said fasteners has a hole formed at the tip, wherein said supporting member has an insertion portion connected to said hole, the diameter of the insertion portion being smaller than that of said hole, and wherein said supporting member and said resin mold are connected through a free space formed between said hole of each of said fasteners and the insertion portion of said member.

12. The reactor as set forth in claim 11, wherein said fasteners are coated with the resin formed integrally with said resin mold.

13. The reactor as set forth in claim 11, wherein said insertion portion is formed in said supporting member and has a ridge portion that is smaller than said hole of each of said fasteners and a bolt that is screwed into said ridge portion.

14. The reactor as set forth in claim 13, wherein said bolt has as said retainer member a flange having a protrusion length that is greater than the diameter of said hole of each of said fasteners, and wherein when said bolt is inserted into said ridge portion, said flange presses the edge of said hole.

15. The reactor as set forth in claim 11, wherein said insertion portion is a bolt that is screwed into said supporting member, wherein said retainer member is a cup-shaped disc spring, wherein said disc spring is located between a head portion of said bolt and the edge of said hole such that the head portion of said bolt presses the edge of said hole through said disc spring.

16. The reactor as set forth in claim 11, wherein said supporting member is made of a metal.

* * * * *